United States Patent [19]

Pedgonay

[11] 4,130,959

[45] Dec. 26, 1978

[54] FIRING TORQUE ERROR CONTROL SYSTEM FOR RIFLED ORDINANCE

[76] Inventor: John S. Pedgonay, P.O. Box 127, Aberdeen, Md. 21001

[21] Appl. No.: 915,737

[22] Filed: Jun. 15, 1978

[51] Int. Cl.[2] ..... F41C 21/00

[52] U.S. Cl. ..... 42/75 B; 42/78

[58] Field of Search ..... 42/78, 76 R, 75 A, 75 B; 89/14 R, 37 R

[56] References Cited

U.S. PATENT DOCUMENTS

| | | | |
|---|---|---|---|
| 299,218 | 5/1884 | Gruson | 89/37 R |
| 1,602,037 | 10/1926 | Mixsell | 89/37 R |
| 2,420,267 | 5/1947 | Sefried | 89/37 R |
| 3,030,865 | 4/1962 | Ridnour | 42/78 |
| 3,738,044 | 6/1973 | Robinson | 42/76 R |

*Primary Examiner*—Charles T. Jordan

*Attorney, Agent, or Firm*—John F. McClellan, Sr.

[57] ABSTRACT

A rifled ordinance mounting system for controlling trajectory errors normally imparted on projectile emergence as result of barrel torsional windup and springback includes a mounting which holds the barrel at the muzzle, the holding being with a torsional rigidity exceeding the torsional rigidity of the barrel.

4 Claims, 2 Drawing Figures

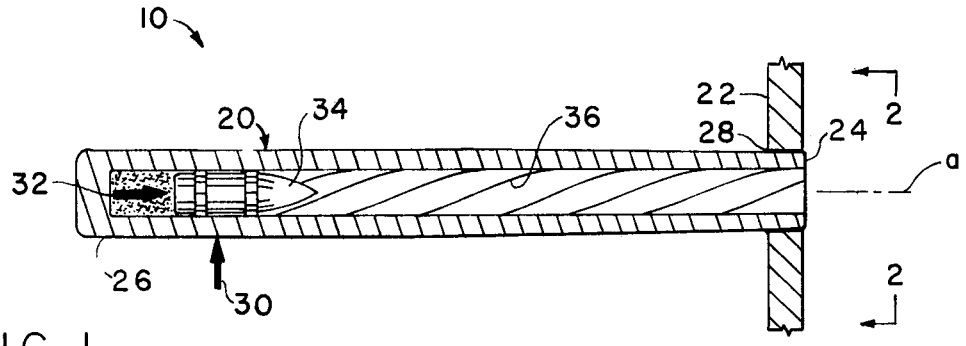
FIG. 1
FIG. 2
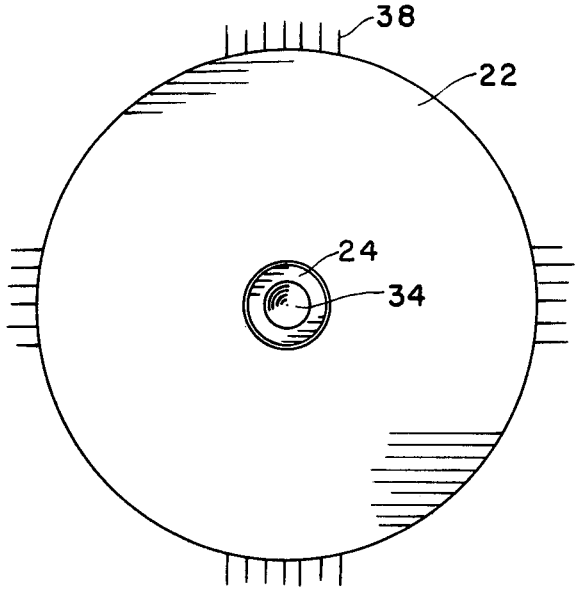

FIRING TORQUE ERROR CONTROL SYSTEM FOR RIFLED ORDINANCE

Cross reference is made to my copending U.S. Pat. application Ser. No.: 900,484, filed Apr. 27, 1978, for ELASTIC REBOUND COMPENSATOR FOR RIFLED GUNBARRELS.

This invention relates generally to ordinance and particularly to barrel mounting systems.

Upon firing of the propulsive charge in a rifled barrel the projectile is torsionally accelerated by the rifling as it progresses along the barrel and, in reaction, the barrel twists or winds up about the long axis. In the transition when the projectile emerges from the muzzle the accelerative forces of the rifling relieve, and the unwinding of the barrel can undesirably perturb the projectile as it breaks contact with the barrel.

Any attempt to prevent barrel torsional flexure altogether to avoid this problem would obviously tend to produce very high stress concentrations and involve unacceptably large and heavy structures.

My above mentioned copending application discloses another approach for coping with the problem and lists patent disclosure material to some degree suggestive of connection with the problem.

In the prior art disclosures also suggestive of connection with this problem have been made in the following U.S. patents:

- U.S. Pat No. 3,738,044 to R. S. Robinson, June 12, 1973, discloses smoothing out reactive torques in a rifled barrel over a period of time and permitting a degree of rotation;
- U.S. Pat. No. 3,030,865 to R. H. Ridnour, Apr. 24, 1962, discloses counteracting torques in rocket launching tubes by interposing in the rocket exhaust fans connected to an inner, rotatable tube;
- U.S. Pat. No. 2,420,267 to H. H. Sefried 2d, May 6, 1947, discloses a biped mount for the end of a rifle barrel, which presumably could be tightened to retard barrel rotation to some degree;
- U.S. Pat. No. 1,602,037 to L. N. D. Mixsell, Oct. 5, 1926, discloses a rifled mortar with what is evidently a free-rotation or ball joint breech mount and with evidently a rotational constraint at the muzzle;
- U.S. Pat. No. 299,218 to H. Gruson, May 27, 1884, suggests anchoring the whole length of a gun in a massive spherical case.

However, it is believed that the critical muzzle-constraint taught by this invention is new and will be found to improve accuracy in a wide range of applications.

In brief summary given for purposes of cursive description only and not as limitation, the invention includes a system torsionally constraining the muzzle of a rifled barrel with a constraint more rigid than the torsional rigidity of the barrel constrained about the long axis of the barrel from the constraint back, while permitting the remainder of the barrel to move torsionally on firing.

The above and other objects and advantages of this invention will become more readily understood on examination of the following description, including the drawings in which like reference numerals refer to like parts:

FIG. 1 is a side elevational fragmentary diagram partly in section; and

FIG. 2 is a view adapted from 2—2, FIG. 1.

FIG. 1 diagrams the invention 10 as a rifled barrel 20 of conventional design, having a support 22 constraining the muzzle end 24 against torsional movement about the longitudinal axis a of the system with a rigidity of constraint exceeding the torsional rigidity of the remainder or free-end of the rifled barrel from constraint to the breech end 26 of the barrel. The support 22 may be thick or thin, of steel or of another material, welded as at 28 or otherwise preferably secured uniformly around the extent of the circumference.

The free end of the barrel may be supported against bending by spring structure, or any other conventional means (arrow 30) preferably not preventing it from moving torsionally when fired, and may have conventional recoil receiving structure if desired.

OPERATION

As a result of firing, as a conventional explosive charge, arrow 32, impels a conventional projectile 34 along the barrel and the rifling 36 conventionally accelerates the projectile in rotation, the barrel can relieve some of the stresses by torsional flexure in portions other than the muzzle, but the muzzle is prevented from unwinding as the projectile emerges and thus is prevented from flipping the trailing contact point of the projectile and perturbing the trajectory. In addition, the muzzle position as last contact is stabilized against lateral vibrations; even though the free end of the barrel whips, the muzzle will tend to remain where pointed and so-direct the projectile.

FIG. 2 shows schematically the face view of the invention, shape of the support 22 being indicated schematically as circular and itself heavily supported (ground symbols 38) only to emphasize provision of the critical torsional constraint necessary. Within the bounds of the invention the exact constraint and elevation and aximuth pointing structures may be arrived at according to any conventional design procedures.

In conclusion, although other structures superficially resembling this invention may have appeared, the invention itself for reasons given is believed to satisfy long sought but never before found requirements.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a rifled barrel system for firing a projectile and having means for constraining the muzzle thereof and a characteristic torsional rigidity between muzzle and breech about the longitudinal axis thereof, the improvement comprising: the means for constraining said muzzle proportioned for constraining the muzzle against torsional movement about the longitudinal axis with a rigidity greater than said characteristic torsional rigidity of the rifled barrel, and means permitting said torsional movement of the rifled barrel otherwise than at said means for constraining, upon firing.

2. In a rifled barrel system as recited in claim 1, said means for constraining extending around the muzzle for providing uniformity of said constraint against torsional movement.

3. A method of improving accuracy of projectile firing through a rifled barrel having a characteristic torsional rigidity about the axis thereof from muzzle to breech, comprising the steps:

(a) constraining the muzzle of the rifled barrel against torsional motion with a rigidity of constraint exceeding said characteristic torsional rigidity of the rifled barrel, and (b) permitting torsional movement of the rifled barrel otherwise than at said constraining of the muzzle.

4. A method of improving accuracy as recited in claim 3, wherewith said constraining of the muzzle extends around the muzzle.

* * * * *

UNITED STATES PATENT AND TRADEMARK OFFICE

CERTIFICATE OF CORRECTION

PATENT NO. : 4,130,959

DATED : 12-26-78

INVENTOR(S) : JOHN S. PEDGONAY

It is certified that error appears in the above-identified patent and that said Letters Patent are hereby corrected as shown below:

In the Title, line 2 delete "ordinance" and insert --ordnance --;

In the Abstract, line 1 delete "ordinance" and insert --ordnance--;

In the specification, col. 1, line 8, delete "ordinance" and insert -- ordnance --.

Signed and Sealed this

Ninth Day of December 1980

[SEAL]

*Attest:*

SIDNEY A. DIAMOND

*Attesting Officer*

*Commissioner of Patents and Trademarks*